US009855468B1

(12) United States Patent
Huang

(10) Patent No.: US 9,855,468 B1
(45) Date of Patent: Jan. 2, 2018

(54) ELASTIC SPHEROID STRUCTURE

(71) Applicant: GATEWAY CORP., New Taipei (TW)

(72) Inventor: Sheng-Mou Huang, New Taipei (TW)

(73) Assignee: GATEWAY CORP., New Taipei (TW)

( * ) Notice: Subject to any disclaimer, the term of this patent is extended or adjusted under 35 U.S.C. 154(b) by 0 days.

(21) Appl. No.: 15/379,644

(22) Filed: Dec. 15, 2016

(51) Int. Cl.
*A63B 39/00* (2006.01)
*A63B 39/02* (2006.01)
*A63B 43/06* (2006.01)

(52) U.S. Cl.
CPC ..... *A63B 39/02* (2013.01); *A63B 43/06* (2013.01); *A63B 2039/022* (2013.01)

(58) Field of Classification Search
CPC ... A63B 39/02; A63B 43/06; A63B 2039/022; A63B 39/00; A63B 2039/003; A63B 43/007; A63B 67/20; A63B 69/0079; A01K 15/025; A01K 15/026
USPC ..... D21/713
See application file for complete search history.

(56) References Cited

U.S. PATENT DOCUMENTS 2,115,926 A * 5/1938 Hatton ..... A63B 43/02 473/596
2,500,073 A * 3/1950 Hayes ..... A63B 43/007 473/575
5,031,910 A * 7/1991 Kopp ..... A63B 69/002 473/423
5,772,542 A * 6/1998 Gildea ..... A63B 43/007 473/576
5,813,366 A * 9/1998 Mauldin, Jr. ..... A01K 15/025 119/707
8,915,810 B2 * 12/2014 McCarthy ..... A63B 39/00 473/611
D730,461 S * 5/2015 Bennett ..... D21/713
2005/0277499 A1 * 12/2005 Tang ..... A63B 41/085 473/604
2011/0021297 A1 * 1/2011 McCarthy ..... A63B 39/00 473/611
2011/0218064 A1 * 9/2011 Bibby ..... A63B 41/02 473/595
2013/0074780 A1 * 3/2013 Wechsler ..... A01K 15/026 119/710
2015/0367219 A1 * 12/2015 Bibbens ..... A63B 69/0071 473/430

* cited by examiner

*Primary Examiner* — Steven Wong
(74) *Attorney, Agent, or Firm* — Li & Cai Intellectual Property (USA) Office

(57) ABSTRACT

An elastic spheroid structure includes a hollow elastic spheroid body having an elastic spheroid shell, a receiving space formed inside the elastic spheroid shell, and a through opening passing through the elastic spheroid shell and being in air communication with the receiving space. The through opening has a first predetermined shape, the through opening has a first middle portion and a plurality of first extending portions extended outwardly from the first middle portion, and the first predetermined shape of the through opening is formed by connecting the first middle portion and the first extending portions. The elastic spheroid structure further includes a solid elastic cover body disposed inside the through opening of the hollow elastic spheroid body and a connection layer disposed inside the through opening and connected between the elastic spheroid shell and the solid elastic cover body.

6 Claims, 15 Drawing Sheets

ELASTIC SPHEROID STRUCTURE

BACKGROUND OF THE INVENTION

1. Field of the Invention

The instant disclosure relates to an elastic spheroid structure, and more particularly to an elastic spheroid structure for providing resilience without inflation.

2. Description of Related Art

Many sports, such as soccer, football, rugby, volley ball, and basketball, require the use of an inflatable ball that has an inflated internal bladder or bag, generally made of rubber, which, in most cases, is covered by an outer textile layer made of natural or synthetic fibers or filaments. Formed on the outer surface of the ball is a valve in which a valve needle connected to an air pump is inserted and used to inflate the internal bladder or bag. In order to ensure the integrity of the textile layer, it is combined with a composition, which is generally vulcanized or cured, with a natural or synthetic rubber. A final outer coating is then applied on this composition. The structure and the manufacture methods of inflatable balls are complex.

SUMMARY OF THE INVENTION

One aspect of the instant disclosure relates to an elastic spheroid structure for providing resilience without inflation.

One of the embodiments of the instant disclosure provides an elastic spheroid structure, comprising: a hollow elastic spheroid body, a solid elastic cover body and a connection layer. The hollow elastic spheroid body has an elastic spheroid shell, a receiving space formed inside the elastic spheroid shell, and a through opening passing through the elastic spheroid shell and being in air communication with the receiving space, and the through opening has a first predetermined shape. The solid elastic cover body is disposed inside the through opening of the hollow elastic spheroid body, and the solid elastic cover body has a second predetermined shape substantially the same as the first predetermined shape of the through opening. The connection layer is disposed inside the through opening and connected between the elastic spheroid shell and the solid elastic cover body. A spheroid head of a mold core for forming the hollow elastic spheroid body is moved out of the receiving space of the hollow elastic spheroid body through the through opening.

Another one of the embodiments of the instant disclosure provides an elastic spheroid structure, comprising: a hollow elastic spheroid body having an elastic spheroid shell, a receiving space formed inside the elastic spheroid shell, and a through opening passing through the elastic spheroid shell and being in air communication with the receiving space. The through opening has a first predetermined shape, the through opening has a first middle portion and a plurality of first extending portions extended outwardly from the first middle portion, and the first predetermined shape of the through opening is formed by connecting the first middle portion and the first extending portions.

Yet another one of the embodiments of the instant disclosure provides an elastic spheroid structure, comprising: a hollow elastic spheroid body having an elastic spheroid shell, a receiving space formed inside the elastic spheroid shell, and a through opening passing through the elastic spheroid shell and being in air communication with the receiving space. The through opening has a first middle portion and a plurality of first extending portions extended outwardly from the first middle portion, and the through opening is an unoccupied passageway.

Therefore, the elastic spheroid structure of the instant disclosure can provide resilience without inflation due to the features of "the hollow elastic spheroid body having an elastic spheroid shell, a receiving space formed inside the elastic spheroid shell, and a through opening passing through the elastic spheroid shell and being in air communication with the receiving space" and "the through opening having a first middle portion and a plurality of first extending portions extended outwardly from the first middle portion", thus the spheroid head of the mold core for forming the hollow elastic spheroid body can be moved out of the receiving space of the hollow elastic spheroid body through the through opening.

To further understand the techniques, means and effects of the instant disclosure, the following detailed descriptions and appended drawings are hereby referred to, such that, and through which, the purposes, features and aspects of the instant disclosure can be thoroughly and concretely appreciated. However, the appended drawings are provided solely for reference and illustration, without any intention to limit the instant disclosure.

BRIEF DESCRIPTION OF THE DRAWINGS

The accompanying drawings are included to provide a further understanding of the instant disclosure, and are incorporated in and constitute a part of this specification. The drawings illustrate exemplary embodiments of the instant disclosure and, together with the description, serve to explain the principles of the instant disclosure.

DETAILED DESCRIPTION OF THE PREFERRED EMBODIMENTS

Figure 1:
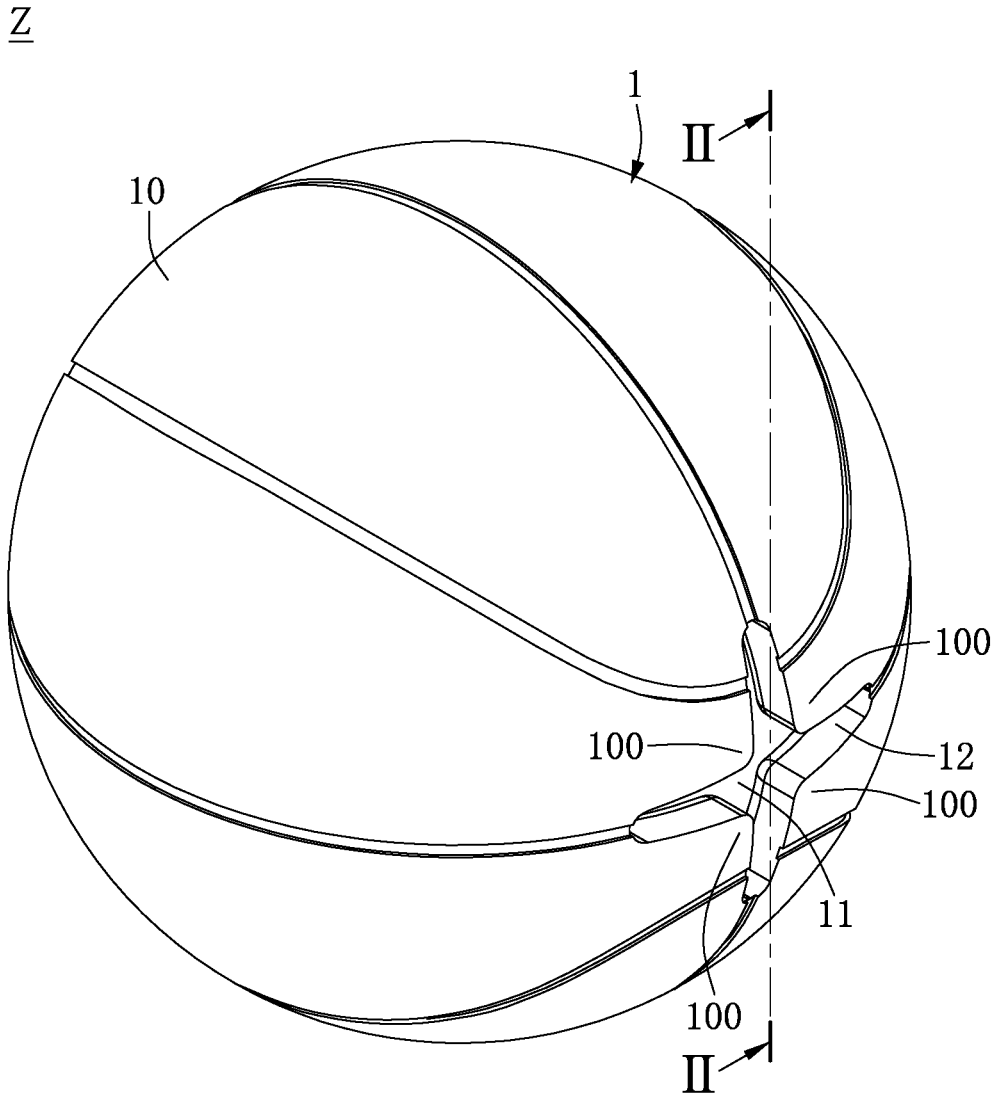
FIG. 1 shows a perspective schematic view of the elastic spheroid structure according to the first embodiment of the instant disclosure.
Figure 2:
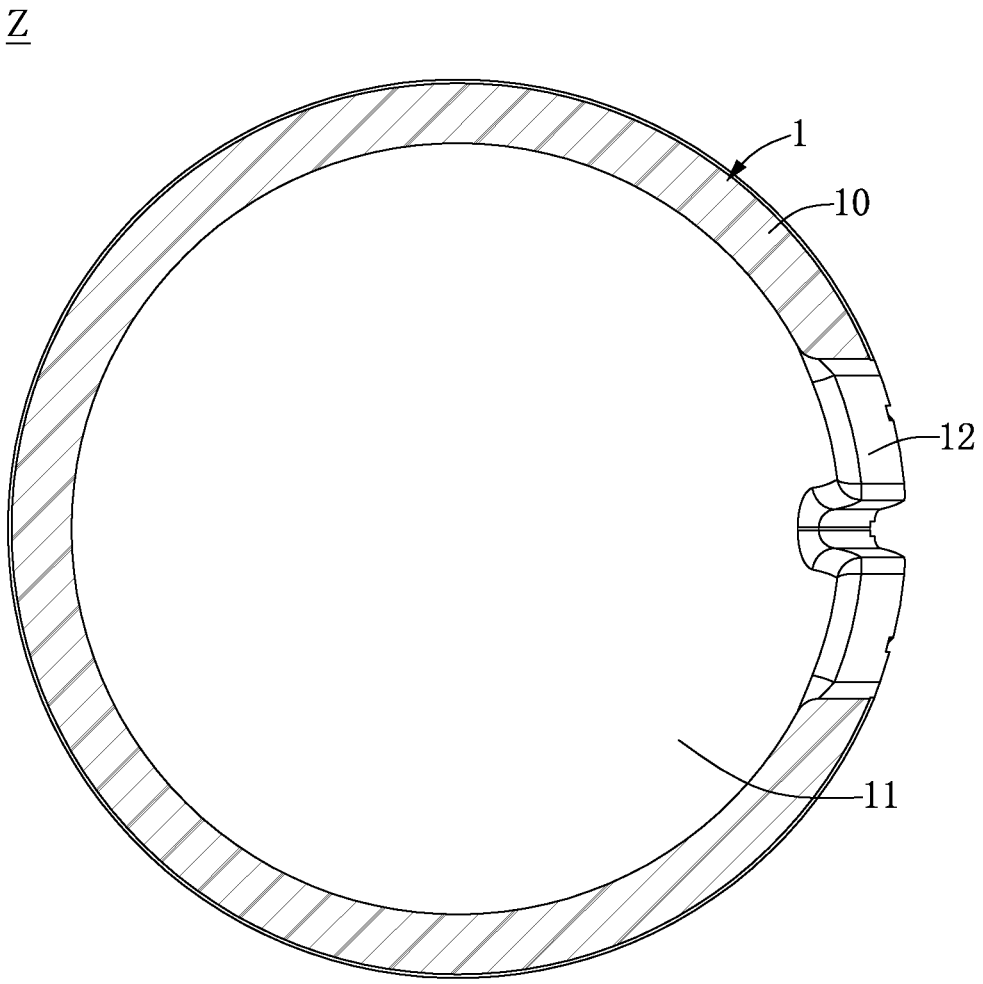
FIG. 2 shows a cross-sectional view taken along the section line II-II of FIG. 1.

Embodiments of an elastic spheroid structure according to the instant disclosure are described herein. Other advantages and objectives of the instant disclosure can be easily understood by one skilled in the art from the disclosure. The instant disclosure can be applied in different embodiments. Various modifications and variations can be made to various details in the description for different applications without departing from the scope of the instant disclosure. The drawings of the instant disclosure are provided only for simple illustrations, but are not drawn to scale and do not reflect the actual relative dimensions. The following embodiments are provided to describe in detail the concept of the instant disclosure, and are not intended to limit the scope thereof in any way.

First Embodiment

Referring to FIG. 1 to FIG. 4, the first embodiment of the instant disclosure provides an elastic spheroid (e.g., ball, sphere, sphericity, or spherical) structure Z, comprising a hollow elastic spheroid body 1, and the hollow elastic spheroid body 1 has an elastic spheroid shell 10, a receiving space 11 formed inside the elastic spheroid shell 10, and a through opening 12 passing through the elastic spheroid shell 10 and being in air communication with the receiving space 12. For example, the hollow elastic spheroid body 1 may be an EVA elastic ball made of an EVA (Ethylene Vinyl Acetate) material, but that is merely an example and is not meant to limit the instant disclosure.

Figure 3:
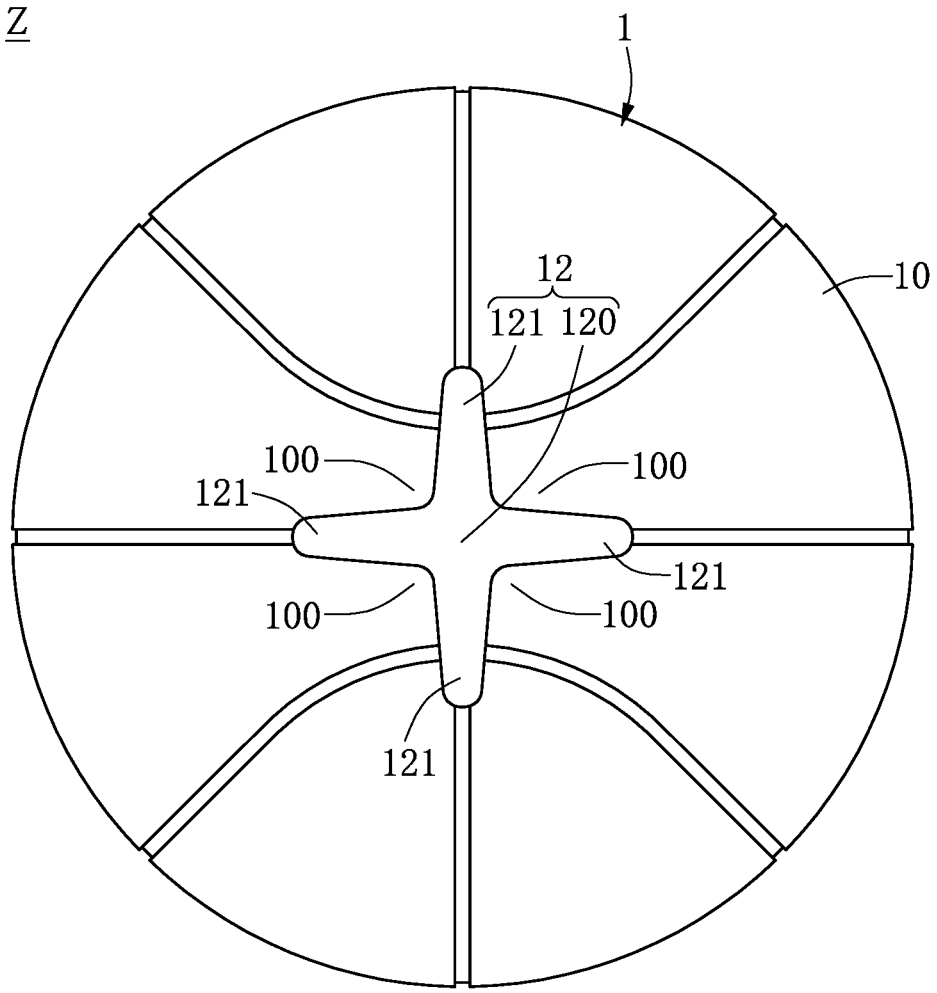
FIG. 3 shows a lateral schematic view of the elastic spheroid structure according to the first embodiment of the instant disclosure.
Figure 4:
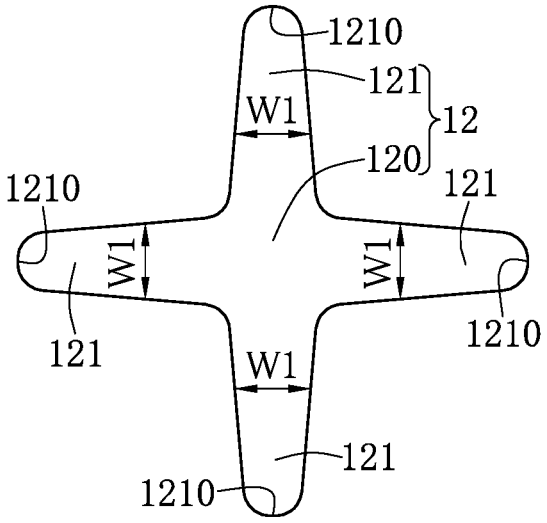
FIG. 4 shows a schematic view of a first type of passing opening according to the first embodiment of the instant disclosure.

First, referring to FIG. 1, FIG. 3 and FIG. 4, the elastic spheroid shell 10 has a plurality of movable portions 100, and the through opening 12 has a first middle portion 120 and a plurality of first extending portions 121 extended outwardly from the first middle portion 120. More particularly, the number of the movable portions 100 of the elastic spheroid shell 10 is the same as the number of the first extending portions 121 of the through opening 12, and each movable portion 100 is connected between the two adjacent first extending portions 121. In addition, the first middle portion 120 is an unoccupied middle portion, and the first extending portion 121 is an unoccupied extending portion, that is to say, the through opening 12 is an unoccupied passageway so that the hollow elastic spheroid body 1 is an elastic ball for showing the unoccupied through opening 12 without using extra cover body to seal the through opening 12.

Moreover, referring to FIG. 3 and FIG. 4, the through opening 12 has a first predetermined shape, and the first predetermined shape of the through opening 12 can be formed by connecting or matching the first middle portion 120 and the first extending portions 121. More particularly, each first extending portion 121 has a progressive width W1 gradually decreased from the first middle portion 120 to an end of the first extending portion 121, and each first extending portion 121 has a first arc surface 1210 formed on the end thereof.

Figure 5:
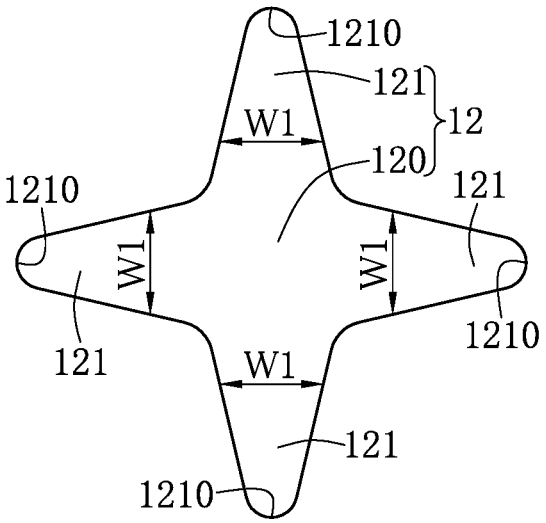
FIG. 5 shows a schematic view of a second type of passing opening according to the first embodiment of the instant disclosure.
Figure 6:
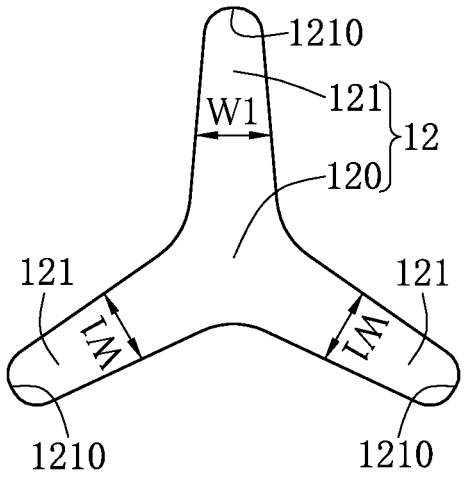
FIG. 6 shows a schematic view of a third type of passing opening according to the first embodiment of the instant disclosure.
Figure 7:
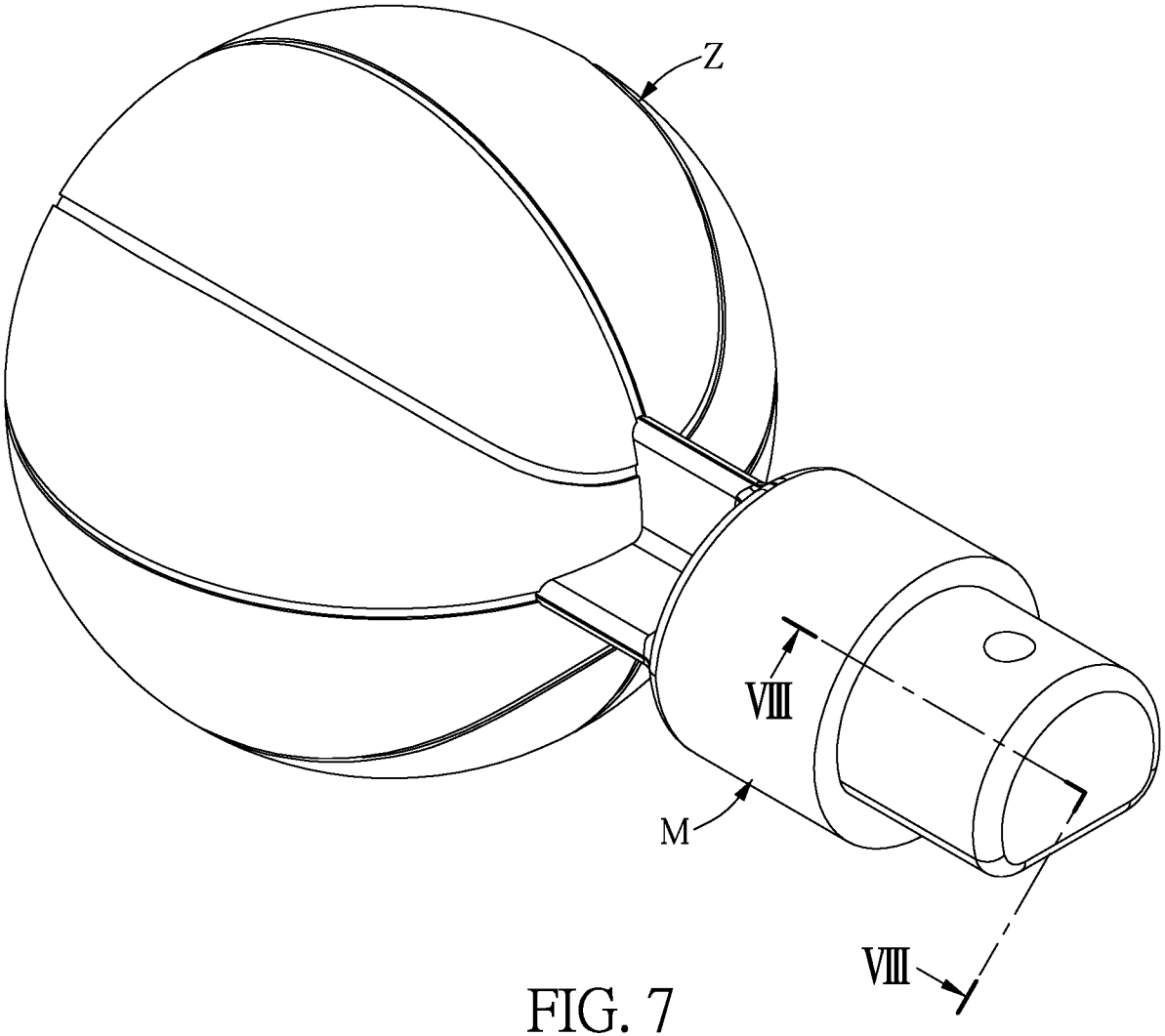
FIG. 7 shows a perspective schematic view of the spheroid head of the mold core before being moved out of the receiving space of the hollow elastic spheroid body according to the first embodiment of the instant disclosure.
Figure 8:
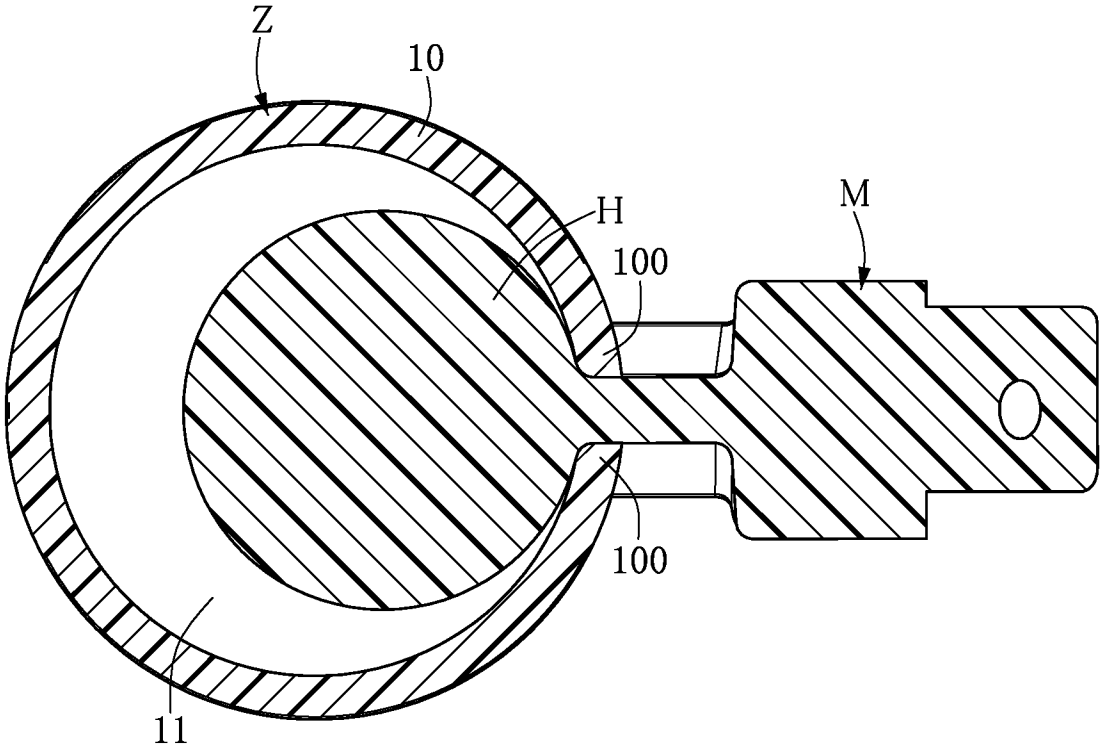
FIG. 8 shows a cross-sectional view taken along the section line VIII-VIII of FIG. 7.

For example, as shown in FIG. 4 or FIG. 5, the through opening 12 can use four first extending portions 121 so that the first predetermined shape of the through opening 12 can be shown as a cross shape (as shown in FIG. 4) or a star shape (as shown in FIG. 5). Alternatively, the through opening 12 can use three first extending portions 121 so that the first predetermined shape of the through opening 12 can be formed as shown in FIG. 6.

Figure 9:
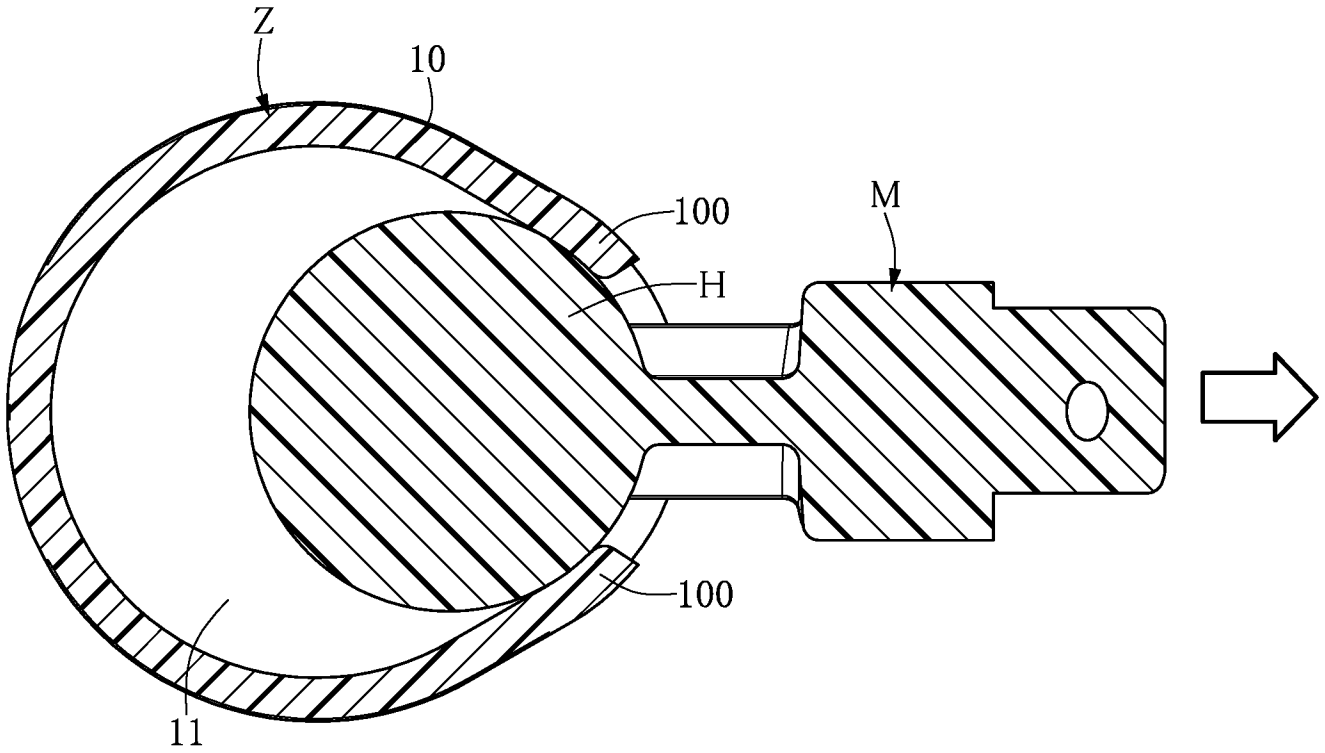
FIG. 9 shows a perspective schematic view of the spheroid head of the mold core when being moved out of the receiving space of the hollow elastic spheroid body according to the first embodiment of the instant disclosure.
Figure 10:
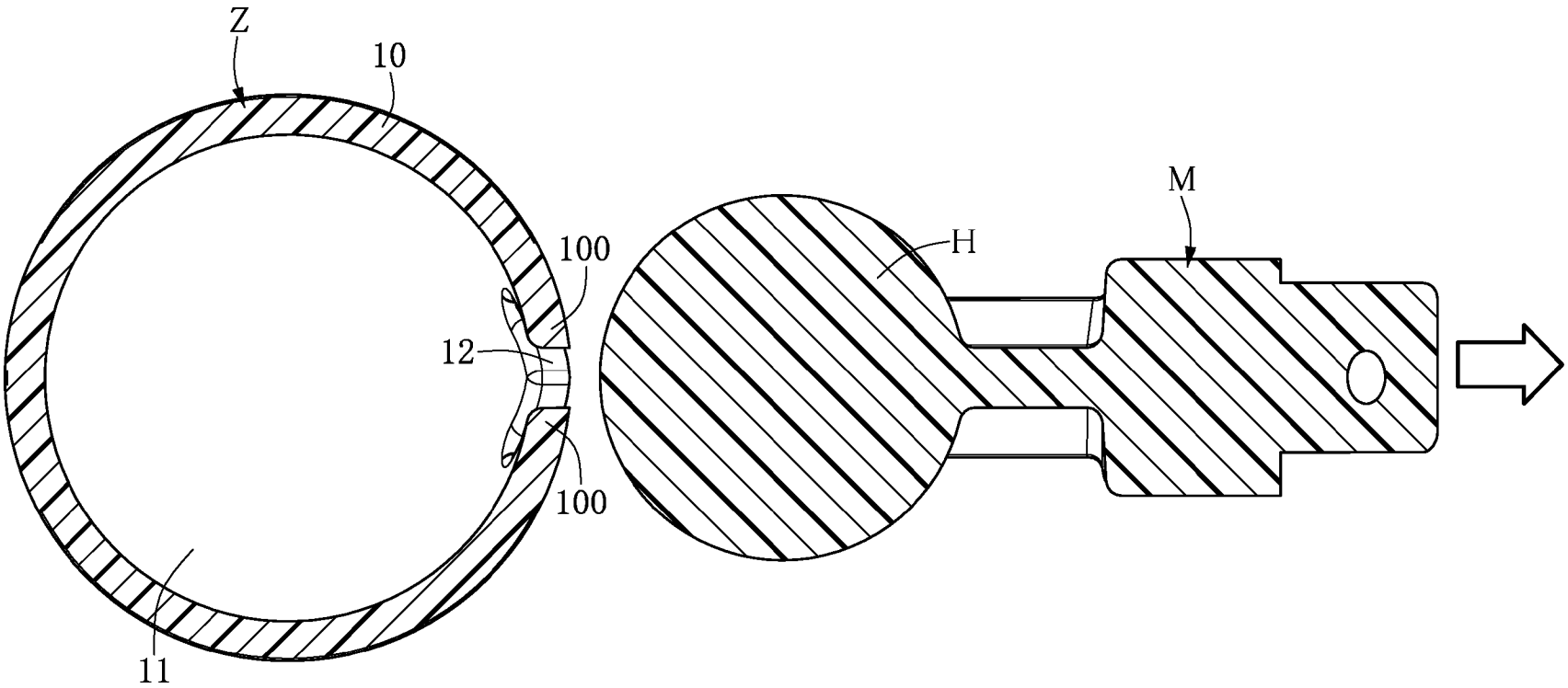
FIG. 10 shows a perspective schematic view of the spheroid head of the mold core after being moved out of the receiving space of the hollow elastic spheroid body according to the first embodiment of the instant disclosure.

More particularly, referring to FIG. 7 to FIG. 10, because the first predetermined shape of the through opening 12 is formed by connecting the first middle portion 120 and the first extending portions 121, the number of the movable portions 100 of the elastic spheroid shell 10 and the number of the first extending portions 121 of the through opening 12 are the same. Hence, when a spheroid head H of a mold core M for forming the hollow elastic spheroid body 1 wants to move out of the receiving space 11 of the hollow elastic spheroid body 1, the movable portions 100 of the elastic spheroid shell 10 can be outwardly pushed by the spheroid head H of the mold core M (as shown in FIG. 9) so as to smoothly separate the spheroid head H from the receiving space 11 of the hollow elastic spheroid body 1 through the through opening 12 (as shown in FIG. 10). That is to say, the spheroid head H of the mold core M for forming the hollow elastic spheroid body 1 can be smoothly moved out of the receiving space 11 of the hollow elastic spheroid body 1 through the through opening 12.

Second Embodiment

Referring to FIG. 11 to FIG. 14, the second embodiment of the instant disclosure provides an elastic spheroid structure Z, comprising a hollow elastic spheroid body 1, a solid elastic cover body 2 and a connection layer 3.

Figure 11:
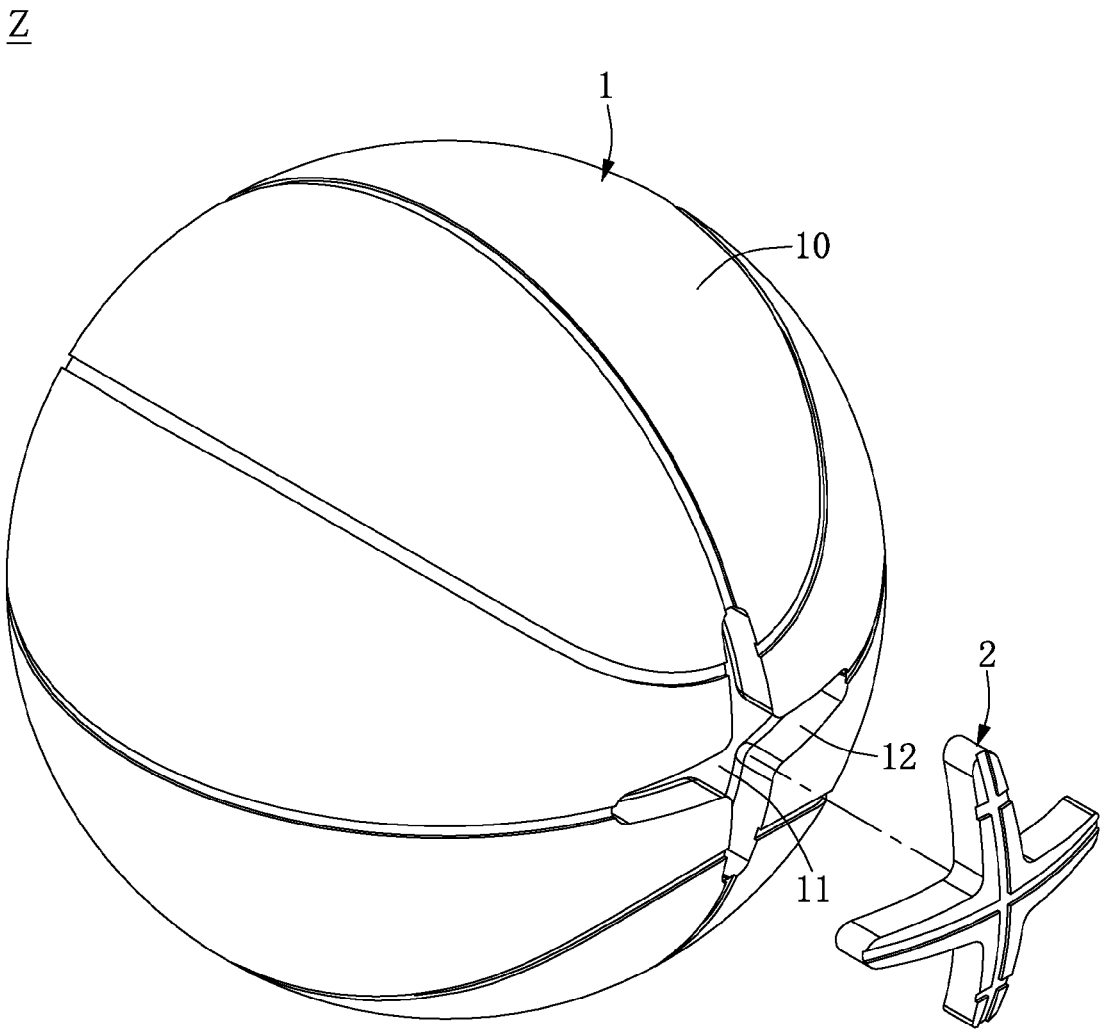
FIG. 11 shows a perspective exploded schematic view of the elastic spheroid structure according to the second embodiment of the instant disclosure.
Figure 12:
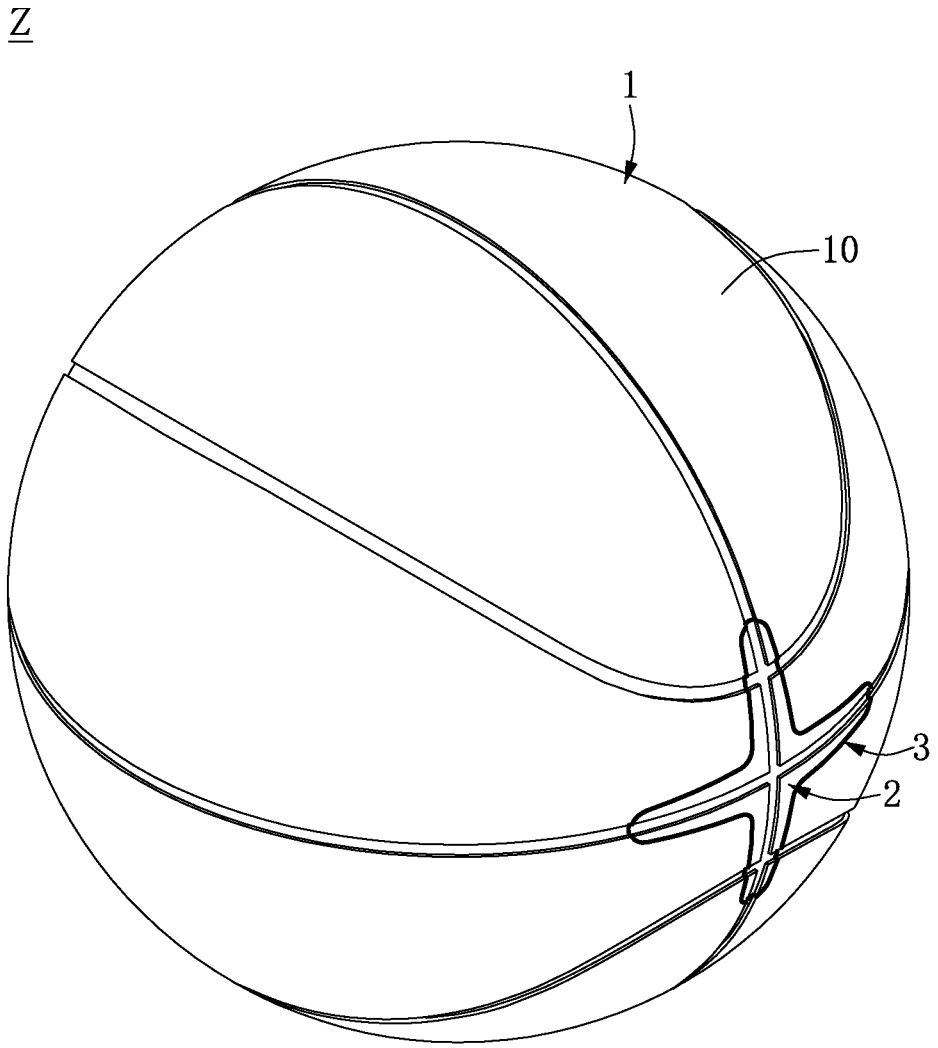
FIG. 12 shows a perspective assembled schematic view of the elastic spheroid structure according to the second embodiment of the instant disclosure.

First, referring to FIG. 11 and FIG. 12, the hollow elastic spheroid body 1 has an elastic spheroid shell 10, a receiving space 11 formed inside the elastic spheroid shell 10, and a through opening 12 passing through the elastic spheroid shell 10 and being in air communication with the receiving space 12. For example, the hollow elastic spheroid body 1 may be an EVA elastic ball made of an EVA (Ethylene Vinyl Acetate) material, but that is merely an example and is not meant to limit the instant disclosure.

More particularly, referring to FIG. 3, FIG. 4 and FIG. 11, the elastic spheroid shell 10 has a plurality of movable portions 100, and the through opening 12 has a first middle portion 120 and a plurality of first extending portions 121 extended outwardly from the first middle portion 120. In addition, the number of the movable portions 100 of the elastic spheroid shell 10 is the same as the number of the first extending portions 121 of the through opening 12, and each movable portion 100 is connected between the two adjacent first extending portions 121.

More particularly, referring to FIG. 3, FIG. 4 and FIG. 11, the through opening 12 has a first predetermined shape, and the first predetermined shape of the through opening 12 can be formed by connecting the first middle portion 120 and the first extending portions 121. In addition, each first extending portion 121 has a progressive width W1 gradually decreased from the first middle portion 120 to an end of the first extending portion 121, and each first extending portion 121 has a first arc surface 1210 formed on the end thereof.

Figure 14:
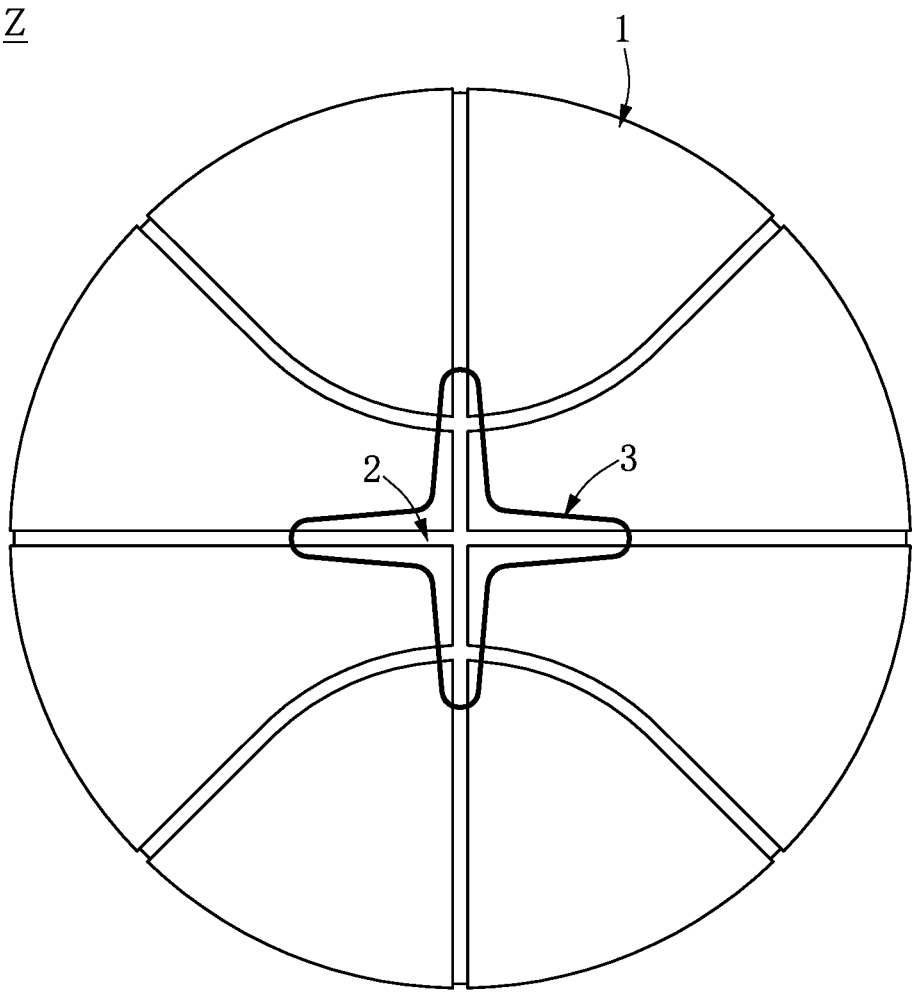
FIG. 14 shows a front assembled schematic view of the elastic spheroid structure according to the second embodiment of the instant disclosure.

Moreover, referring to FIG. 11, FIG. 12 and FIG. 14, the solid elastic cover body 2 is disposed inside the through opening 12 of the hollow elastic spheroid body 1, and the solid elastic cover body 2 has a second predetermined shape substantially the same as the first predetermined shape of the through opening 12. In addition, the connection layer 3 is disposed inside the through opening 12 and connected between the inner surface of the elastic spheroid shell 10 and the outer surface of the solid elastic cover body 2.

Figure 13:
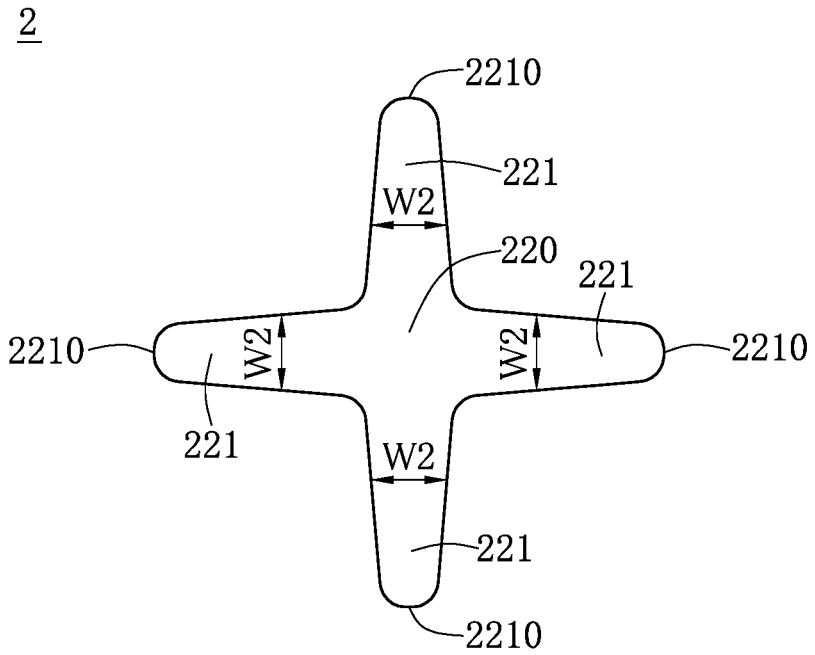
FIG. 13 shows a front schematic view of the solid elastic cover body of the elastic spheroid structure according to the second embodiment of the instant disclosure.

More particularly, referring to FIG. 4 and FIG. 13, the solid elastic cover body 2 has a second middle portion 220 corresponding to the first middle portion 120 and a plurality of second extending portions 221 extended outwardly from the second middle portion 220 and respectively corresponding to the first extending portions 121, and the second predetermined shape of the solid elastic cover body 2 is formed by connecting the second middle portion 220 and the second extending portions 221. In addition, each second extending portion 221 has a progressive width W2 gradually decreased from the second middle portion 220 to an end of the second extending portion 221, and each second extending portion 221 has a second arc surface 2210 formed on the end thereof.

For example, the solid elastic cover body 2 is made of thermosetting material or thermoplastic material. In addition, the solid elastic cover body 2 has fluorescence material particles or a fluorescent layer so as to show a color light by receiving a light source.

Figure 15:
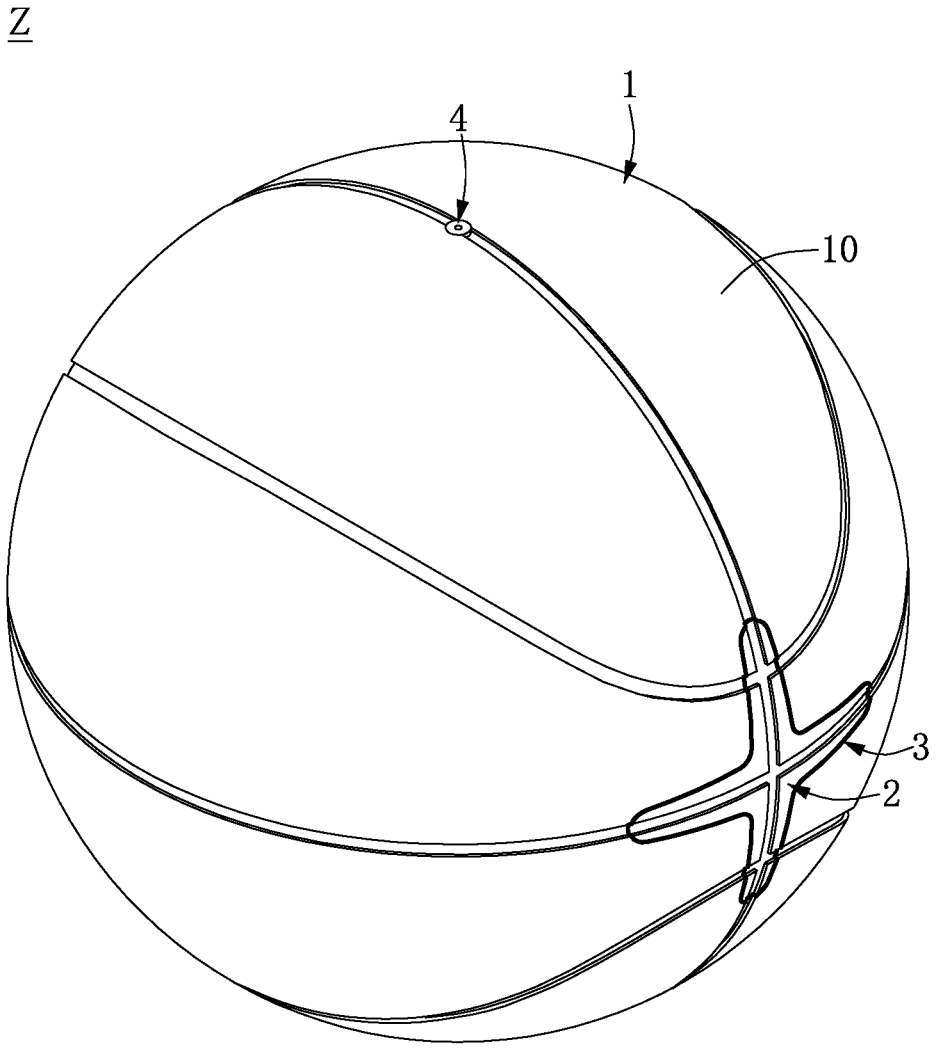
FIG. 15 shows a perspective assembled schematic view of the hollow elastic spheroid body of the elastic spheroid structure having an exhaust hole according to the second embodiment of the instant disclosure.
Figure 16:
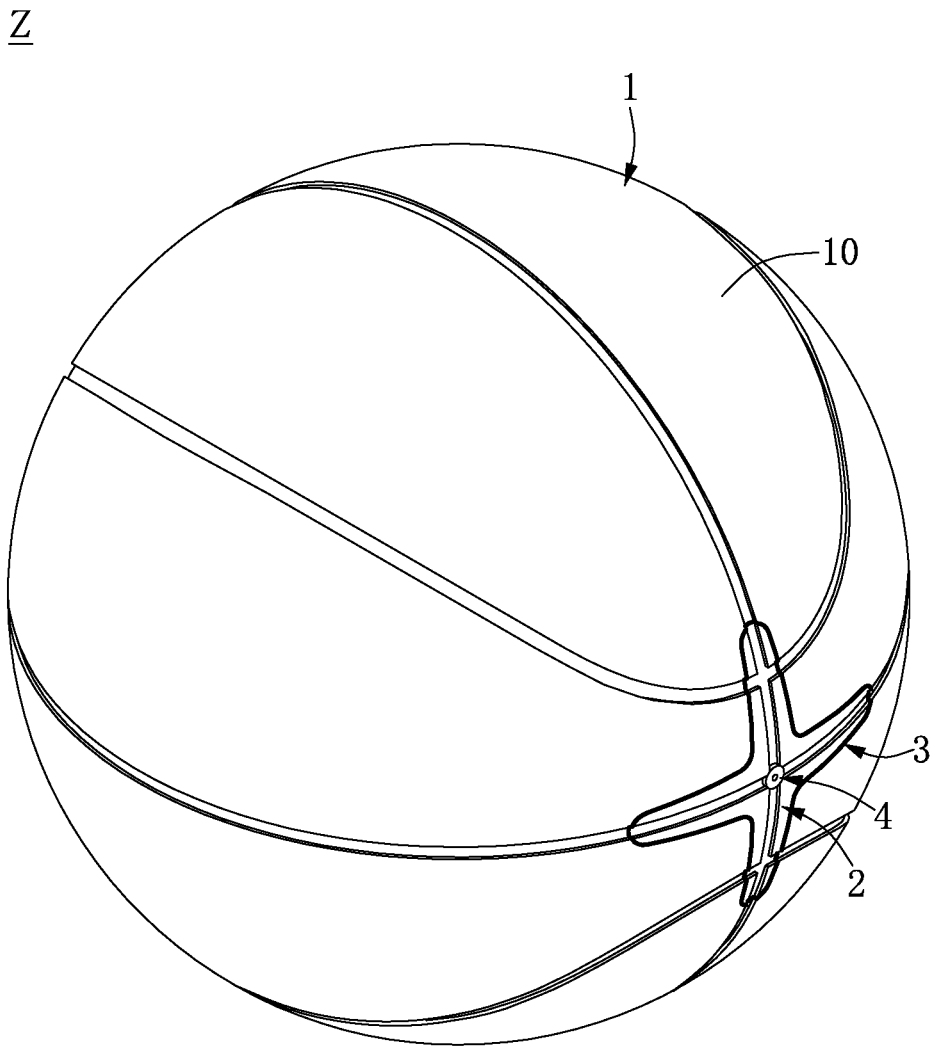
FIG. 16 shows a perspective assembled schematic view of the solid elastic cover body of the elastic spheroid structure having an exhaust hole according to the second embodiment of the instant disclosure.

Please note, the elastic spheroid structure Z of the second embodiment of the instant disclosure further provides an exhaust hole 4 that is disposed on one of the hollow elastic spheroid body 1 and the solid elastic cover body 2 and is in air communication with the receiving space 11. For example, as shown in FIG. 15, the elastic spheroid structure Z provides an exhaust hole 4 that is in air communication with the receiving space 11 and can pass through the hollow elastic spheroid body 1. As shown in FIG. 16, the elastic spheroid structure Z provides an exhaust hole 4 that is in air communication with the receiving space 11 and can pass through the solid elastic cover body 2.

In conclusion, the elastic spheroid structure Z of the instant disclosure can provide resilience without inflation due to the features of "the hollow elastic spheroid body 1 having an elastic spheroid shell 10, a receiving space 11 formed inside the elastic spheroid shell 10, and a through opening 12 passing through the elastic spheroid shell 10 and being in air communication with the receiving space 11" and "the through opening 12 having a first middle portion 120 and a plurality of first extending portions 121 extended outwardly from the first middle portion 120", thus the spheroid head H of the mold core M for forming the hollow elastic spheroid body 1 can be moved out of the receiving space 11 of the hollow elastic spheroid body 1 through the through opening 12.

The aforementioned descriptions merely represent the preferred embodiments of the instant disclosure, without any intention to limit the scope of the instant disclosure which is fully described only within the following claims. Various equivalent changes, alterations or modifications based on the claims of the instant disclosure are all, consequently, viewed as being embraced by the scope of the instant disclosure.

What is claimed is:

1. An elastic spheroid structure, comprising:

a hollow elastic spheroid body having an elastic spheroid shell, a receiving space formed inside the elastic spheroid shell, and a through opening passing through the elastic spheroid shell and being in air communication with the receiving space, wherein the through opening has a first predetermined shape;

a solid elastic cover body disposed inside the through opening of the hollow elastic spheroid body, wherein the solid elastic cover body has a second predetermined shape substantially the same as the first predetermined shape of the through opening; and a connection layer disposed inside the through opening and connected between the elastic spheroid shell and the solid elastic cover body;

wherein a spheroid head of a mold core for forming the hollow elastic spheroid body is moved out of the receiving space of the hollow elastic spheroid body through the through opening;

wherein the through opening has a first middle portion and a plurality of first extending portions extended outwardly from the first middle portion, and the first predetermined shape of the through opening is formed by connecting the first middle portion and the first extending portions;

wherein the solid elastic cover body has a second middle portion corresponding to the first middle portion and a plurality of second extending portions extended outwardly from the second middle portion and respectively corresponding to the first extending portions, and the second predetermined shape of the solid elastic cover body is formed by connecting the second middle portion and the second extending portions.

2. The elastic spheroid structure of claim 1, wherein an exhaust hole is disposed on one of the hollow elastic spheroid body and the solid elastic cover body and being in air communication with the receiving space.

3. The elastic spheroid structure of claim 2, wherein each first extending portion has a progressive width gradually decreased from the first middle portion to an end of the first extending portion, and each first extending portion has a first arc surface formed on the end thereof, wherein each second extending portion has a progressive width gradually decreased from the second middle portion to an end of the second extending portion, and each second extending portion has a second arc surface formed on the end thereof, wherein the elastic spheroid shell has a plurality of movable portions, the number of the movable portions is the same as the number of the first extending portions, each movable portion is connected between the two adjacent first extending portions, and the movable portions are outwardly pushed by the spheroid head of the mold core so as to smoothly separate the spheroid head from the receiving space of the hollow elastic spheroid body through the through opening.

4. An elastic spheroid structure, comprising: a hollow elastic spheroid body having an elastic spheroid shell, a receiving space formed inside the elastic spheroid shell, and a through opening passing through the elastic spheroid shell and being in air communication with the receiving space, wherein the through opening has a first predetermined shape, the through opening has a first middle portion and a plurality of first extending portions extended outwardly from the first middle portion, and the first predetermined shape of the through opening is formed by connecting the first middle portion and the first extending portions;

wherein the elastic spheroid structure further comprises:

a solid elastic cover body disposed inside the through opening of the hollow elastic spheroid body, wherein the solid elastic cover body has a second predetermined shape substantially the same as the first predetermined shape of the through opening; and a connection layer disposed inside the through opening and connected between the elastic spheroid shell and the solid elastic cover body.

5. The elastic spheroid structure of claim 4, wherein the solid elastic cover body has a second middle portion corresponding to the first middle portion and a plurality of second extending portions extended outwardly from the second middle portion and respectively corresponding to the first extending portions, and the second predetermined shape of the solid elastic cover body is formed by connecting the second middle portion and the second extending portions, wherein an exhaust hole is disposed on one of the hollow elastic spheroid body and the solid elastic cover body and being in air communication with the receiving space.

6. The elastic spheroid structure of claim 5, wherein each first extending portion has a progressive width gradually decreased from the first middle portion to an end of the first extending portion, and each first extending portion has a first arc surface formed on the end thereof, wherein each second extending portion has a progressive width gradually decreased from the second middle portion to an end of the second extending portion, and each second extending portion has a second arc surface formed on the end thereof, wherein the elastic spheroid shell has a plurality of movable portions that have the same number of the first extending portions, and each movable portion is connected between the two adjacent first extending portions.

* * * * *